US007318365B2

(12) United States Patent
Huang

(10) Patent No.: US 7,318,365 B2
(45) Date of Patent: Jan. 15, 2008

(54) MULTISTAGE SOCKET

(76) Inventor: Ping Wen Huang, No. 5, Alley 24, Lane 247, Sinyi St., Wurih Township, Taichung County 414 (TW)

( * ) Notice: Subject to any disclaimer, the term of this patent is extended or adjusted under 35 U.S.C. 154(b) by 106 days.

(21) Appl. No.: 11/405,412

(22) Filed: Apr. 18, 2006

(65) Prior Publication Data

US 2007/0243753 A1 Oct. 18, 2007

(51) Int. Cl.
*B25B 13/18* (2006.01)

(52) U.S. Cl. ..... 81/128

(58) Field of Classification Search ..... 81/57.39, 81/60–63.2, 121.1, 124.4, 128, 185; 76/114
See application file for complete search history.

(56) References Cited

U.S. PATENT DOCUMENTS 3,979,979 A * 9/1976 Grabovac ..... 81/124.4
5,660,088 A * 8/1997 Benson ..... 81/128
5,918,511 A * 7/1999 Sabbaghian et al. ..... 81/128
5,983,757 A * 11/1999 Blise et al. ..... 81/57.39
6,029,547 A * 2/2000 Eggert et al. ..... 81/124.6
6,467,379 B1 * 10/2002 Wizman ..... 81/185
6,971,284 B2 * 12/2005 Owoc ..... 81/58.2
7,062,996 B2 * 6/2006 Johnson ..... 81/128

* cited by examiner

*Primary Examiner*—Khiem Nguyen
(74) *Attorney, Agent, or Firm*—Rosenberg, Klein & Lee

(57) ABSTRACT

A multistage socket including a main body having a disc section. Multiple fixing blocks are disposed on one face of the disc section at equal angular intervals. A movable block is arranged between each two adjacent fixing blocks. The inner end faces of the movable blocks facing the center of the disc section define a polygonal hole. The movable blocks are resiliently movable toward or away from the center of the disc section. A rotary member is rotatably fitted around the disc section of the main body. Multiple arced guide sections are symmetrically formed on an inner face of the rotary member corresponding to the movable blocks. Each arced guide section has multiple recessed arced faces with different thickness. When rotating the rotary member, the outer ends of the movable blocks can abut against the opposite recessed arced faces of the arced guide sections with the same thickness. Therefore, the movable blocks can be located in different recessed arced faces to vary the distance between the movable blocks and the center of the disc section so as to adjust the size of the polygonal hole in accordance with the sizes of different nuts or bolts.

4 Claims, 5 Drawing Sheets

MULTISTAGE SOCKET

BACKGROUND OF THE INVENTION

The present invention is related to a multistage socket in which simply by means of rotating a rotary member, the size of the polygonal hole of the socket can be changed in accordance with the sizes of different nuts or bolts.

FIG. 5 shows a conventional multistage socket including a socket main body 6. The socket main body 6 is formed with a fitting hole 61. The fitting hole 61 has two parallel straight walls formed with opposite teeth 611 at equal intervals. The socket main body 6 is further formed with a through hole 62 and a retaining hole 63 symmetrical to each other in parallel to the straight walls. The multistage socket further includes a resilient member 7 made of a curled steel plate. The resilient member 7 has a central chucking slot 71. Two ends of the resilient member 7 are respectively fitted in the through hole 62 and the retaining hole 63 to bridge the resilient member 7 over-the fitting hole 61. The multistage socket further includes a movable adjustment block 8 having an inner V-shaped face 81 and an arced outer face 82. Two lateral sides of the adjustment block 8 are formed with teeth 83. A mushroom boss 84 protrudes from the center of the bottom of the adjustment block 8. The mushroom boss 84 is chucked in the chucking slot 71 of the resilient member 7. The multistage socket further includes a socket handle 9 having a fitting end 91 for fitting with the socket main body 6. The fitting end 91 is formed with a channel 92 in which the resilient member 7 and the mushroom boss 84 are clamped. According to the above arrangement, the position of the adjustment block 8 can be adjusted in accordance with the size of the nut to define a hexagonal fitting hole together with the socket main body. Therefore, one single socket wrench can have various specifications of hexagonal fitting holes adaptable to various sizes of nuts. A user can conveniently carry the socket wrench to wrench/loosen various sizes of nuts.

However, the conventional multistage socket still has some shortcomings. For example, such socket has complicated structure and is difficult to process. The resilient member is made of curled steel plate and assembled with other components. It is hard to control the precision of the assembly.

SUMMARY OF THE INVENTION

It is therefore a primary object of the present invention to provide a multistage socket the components of which can be easily assembled. In addition, the structure of the multistage socket is simplified so that it is easier to manufacture the multistage socket.

According to the above object, the multistage socket of the present invention includes: a main body having a disc section, at least three fixing blocks being disposed on one face of the disc section at equal angular intervals, two lateral sides of each fixing block being respectively formed with two first cavities extending from outer side toward a center of the disc section, an inner end of each first cavity being formed with a first stop face, the main body further having a coupling section formed on the other face of the disc section; at least three movable blocks each of which is arranged between two adjacent fixing blocks, inner end faces of the movable blocks facing the center of the disc section defining a polygonal hole, outer end face of each movable block being formed with an axially extending arced locating section outward protruding from the outer end face of the movable block, two lateral sides of each movable block being respectively formed with two second cavities adjacent to the two lateral sides of the fixing block, the first cavity of the fixing block and the second cavity of the adjacent movable block communicating with each other, an outer end of each second cavity being formed with a second stop face opposite to the first stop face, the first cavity and the adjacent second cavity together forming a receiving space in which a resilient member is accommodated, two ends of the resilient member respectively abutting against the first and second stop faces; and a rotary member rotatably fitted around the disc section of the main body, the rotary member having a front face formed with a central through hole communicating with the polygonal hole and having an annular wall perpendicularly extending from an outer circumference of the front face, at least three arced guide sections being formed an inner face of the annular wall at intervals, each arced guide section having multiple recessed arced faces, the thickness of the annular wall between the multiple recessed arced faces and the outer circumference of the annular wall being tapered, whereby the locating sections of the movable blocks can abut against the corresponding recessed arced faces of the arced guide sections with the same thickness.

The present invention can be best understood through the following description and accompanying drawings wherein:

DETAILED DESCRIPTION OF THE PREFERRED EMBODIMENTS

Figure 1:
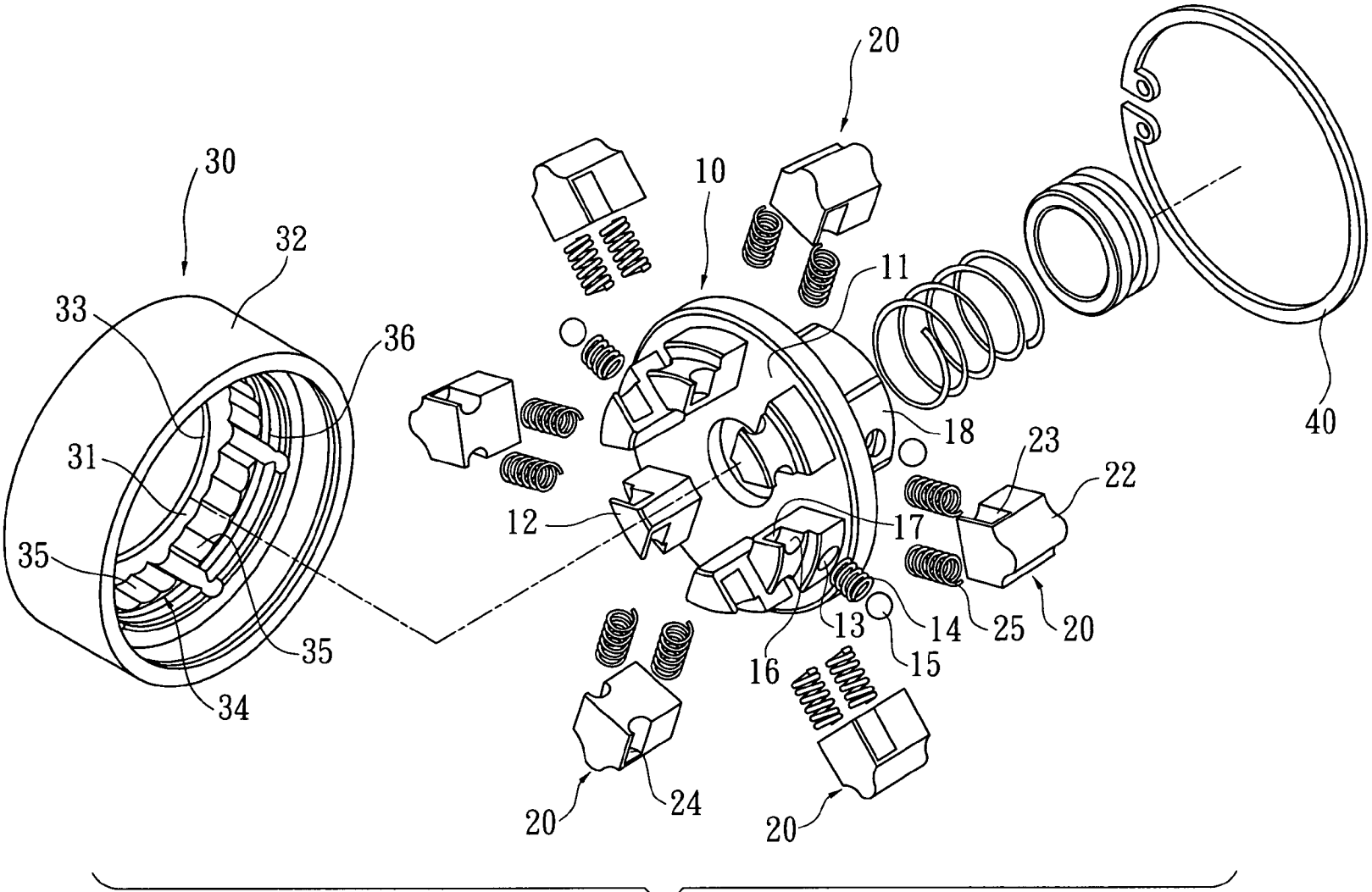
FIG. 1 is a perspective exploded view of the present invention.
Figure 2:
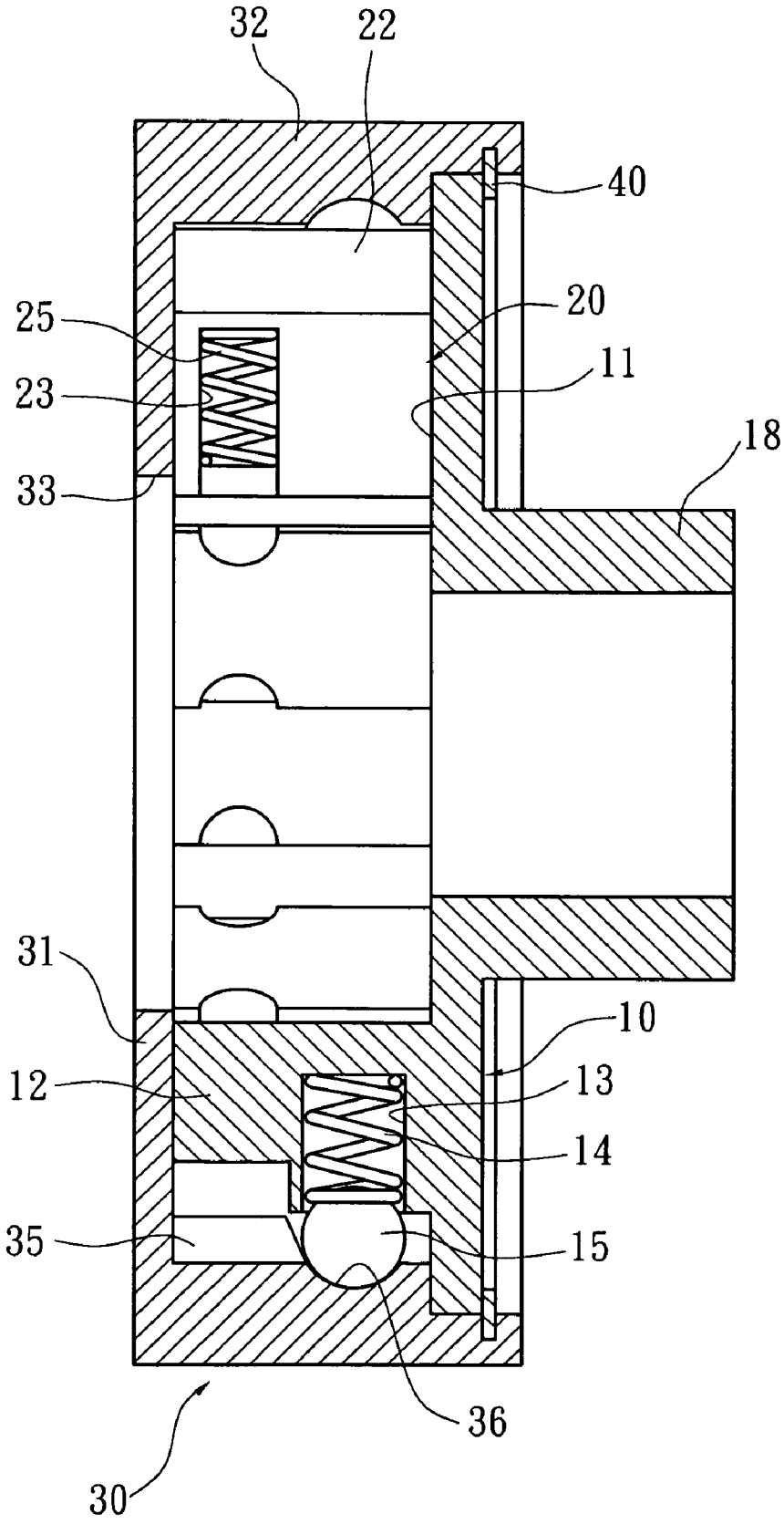
FIG. 2 is a sectional assembled view of the present invention.
Figure 3:
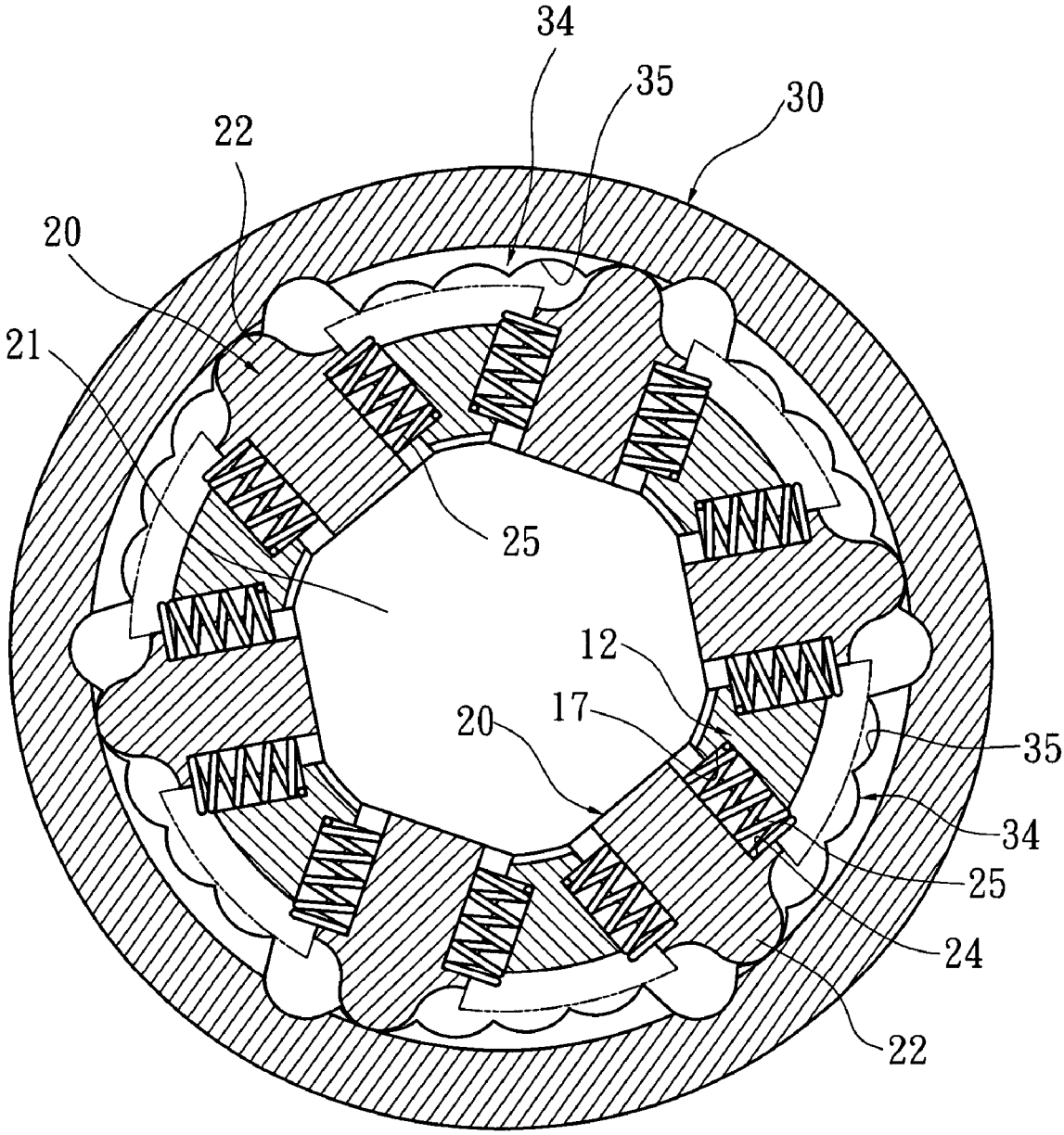
FIG. 3 is a rear sectional view of the present invention.

Please refer to FIGS. 1 to 3. The multistage socket of the present invention includes a main body 10 having a disc section 11. Six fixing blocks 12 are disposed on one face of the disc section 11 at equal angular intervals. The outer faces of two opposite fixing blocks 12 distal from the center of the disc section 11 are respectively formed with two dents 13. A spring 14 and a steel ball 15 are sequentially disposed in each dent 13 from inner side to outer side. Two lateral sides of each fixing block 12 are respectively formed with two first cavities 16 extending from outer side toward the center of the disc section 11. An inner end of each first cavity 16 is formed with a first stop face 17. The main body 10 further has a coupling section formed on the other face of the disc section 11.

The multistage socket of the present invention further includes six movable blocks 20 each of which is arranged between two adjacent fixing blocks 12. The inner end faces of the movable blocks 20 facing the center of the disc section 11 define a hexagonal hole 21. The outer end face of each movable block 20 is formed with an axially extending arced locating section 22 outward protruding from the outer end face of the movable block 20. Two lateral sides of each movable block 20 are respectively formed with two second cavities 23 adjacent to the two lateral sides of the fixing block 12. The first cavity 16 of the fixing block 12 and the second cavity 23 of the adjacent movable block 20 communicate with each other. An outer end of each second cavity 23 is formed with a second stop face 24 opposite to the first stop face 17. The first cavity 16 and the adjacent second cavity 23 together form a receiving space in which a resilient member 25 is accommodated. Two ends of the resilient member 25 respectively abut against the first and second stop faces 17, 24.

The multistage socket of the present invention further includes a rotary member 30 rotatably fitted around the disc section 11 of the main body 10. The rotary member 30 has a front face 31 formed with a central through hole 33 communicating with the hexagonal hole 21. The rotary member 30 further has an annular wall 32 perpendicularly extending from the outer circumference of the front face 31. Six arced guide sections 34 are symmetrically formed an inner face of the annular wall 32 at intervals corresponding to the movable blocks 20. Each arced guide section 34 has multiple recessed arced faces 35. The thickness of the annular wall 32 between the multiple recessed arced faces 35 and the outer circumference of the annular wall 32 is tapered. The locating sections 22 of the movable blocks 20 can abut against the corresponding recessed arced faces 35 of the arced guide sections 34 with the same thickness. In addition, the inner face of the rotary member 30 is formed with an arced rail channel 36 between each two adjacent arced guide sections 34. The steel balls 15 of the two fixing blocks 12 are inlaid in the rail channels 36, whereby the rotary member 30 can be guided by the steel balls 15 and rotated about the disc section 11. A C-shaped retainer ring 40 is disposed at a rear end of the annular wall 32 of the rotary member 30. A front face of the C-shaped retainer ring 40 abuts against the other face of the disc section 11 proximal to the coupling section 18, whereby the rotary member 30 is rotatably disposed around the disc section 11 of the main body 10.

Figure 4:
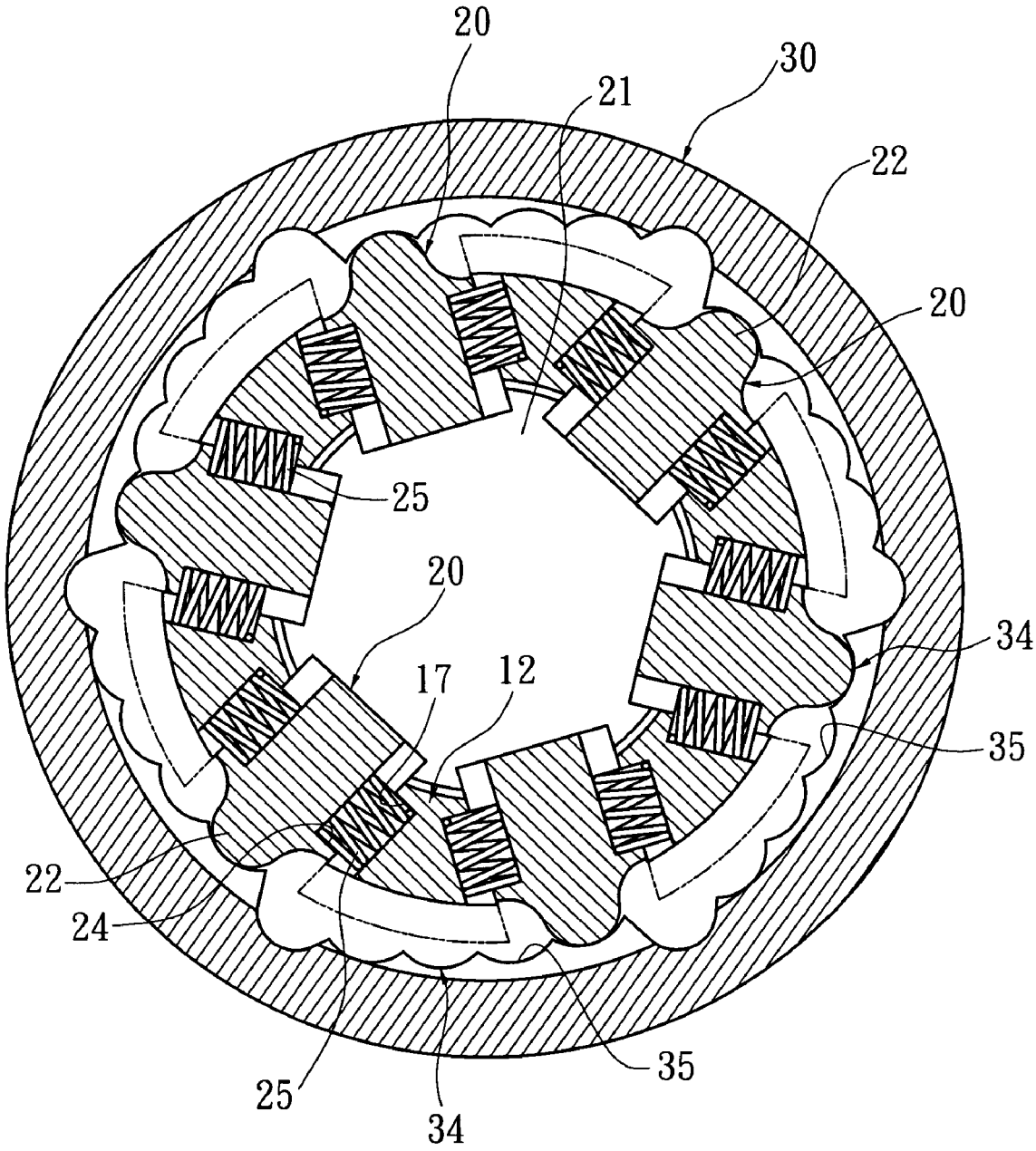
FIG. 4 is a rear sectional view of the present invention according to FIG. 3, in which the hexagonal hole is contracted.
Figure 5:
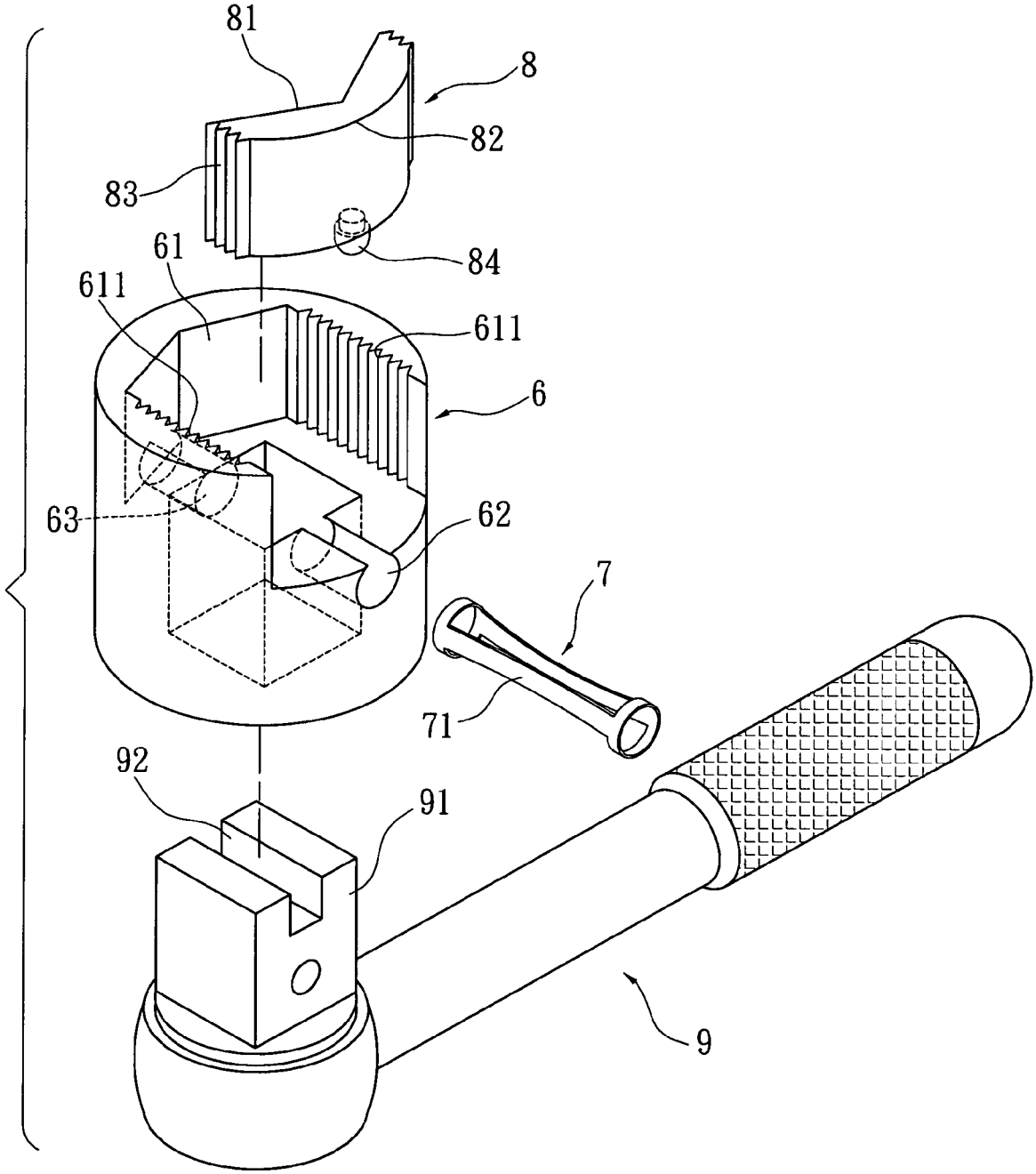
FIG. 5 PRIOR ART
FIG. 5 is a perspective exploded view of a conventional multistage socket.

When adjusting the size of the hexagonal hole 21 defined by the movable blocks 20, the rotary member 30 is rotated as shown in FIGS. 3 and 4. At this time, the steel balls 15 inlaid in the rail channels 36 guide the rotary member 30 to smoothly rotate about the disc section 11. When the locating sections 22 of the movable blocks 20 move between the recessed arced faces 35 of the arced guide sections 34, the movable blocks 20 are inward pushed by the crest sections between the recessed arced faces 35. At this time, the resilient members 25 are compressed. After the locating sections 22 of the movable blocks 20 move to the corresponding recessed arced faces 35 of the arced guide sections 34, the resilient members 25 extend to push the locating sections 22 of the movable blocks 20 into the corresponding recessed arced faces 35. The recessed arced faces 35 of the arced guide sections 34 have different thickness. Therefore, the rotary member can be rotated to locate the locating sections 22 of the movable blocks 20 in different recessed arced faces 35 so as to vary the distance between the movable blocks 20 and the center of the disc section 11. Accordingly, the size of the hexagonal hole 21 defined by the movable blocks 20 can be changed in accordance with the sizes of different nuts or bolts to be wrenched.

According to the above arrangement, simply by means of rotating the rotary member, the size of the hexagonal hole of the socket wrench can be changed in accordance with the sizes of different nuts or bolts to be wrenched. The components of the multistage socket of the present invention can be easily assembled and the structure of the multistage socket of the present invention is simplified. In addition, by means of the arced guide sections of the rotary member, the movable blocks can be precisely located to truly define the hexagonal hole.

The above embodiments are only used to illustrate the present invention, not intended to limit the scope thereof. Many modifications of the above embodiments can be made without departing from the spirit of the present invention.

What is claimed is:

1. A multistage socket comprising:

a main body having a disc section, at least three fixing blocks being disposed on one face of the disc section at equal angular intervals, two lateral sides of each fixing block being respectively formed with two first cavities extending from outer side toward a center of the disc section, an inner end of each first cavity being formed with a first stop face, the main body further having a coupling section formed on the other face of the disc section;

at least three movable blocks each of which is arranged between two adjacent fixing blocks, inner end faces of the movable blocks facing the center of the disc section defining a polygonal hole, outer end face of each movable block being formed with an axially extending arced locating section outward protruding from the outer end face of the movable block, two lateral sides of each movable block being respectively formed with two second cavities adjacent to the two lateral sides of the fixing block, the first cavity of the fixing block and the second cavity of the adjacent movable block communicating with each other, an outer end of each second cavity being formed with a second stop face opposite to the first stop face, the first cavity and the adjacent second cavity together forming a receiving space in which a resilient member is accommodated, two ends of the resilient member respectively abutting against the first and second stop faces; and a rotary member rotatably fitted around the disc section of the main body, the rotary member having a front face formed with a central through hole communicating with the polygonal hole and having an annular wall perpendicularly extending from an outer circumference of the front face, at least three arced guide sections being formed an inner face of the annular wall at intervals, each arced guide section having multiple recessed arced faces, the thickness of the annular wall between the multiple recessed arced faces and the outer circumference of the annular wall being tapered, whereby the locating sections of the movable blocks can abut against the corresponding recessed arced faces of the arced guide sections with the same thickness.

2. The multistage socket as claimed in claim 1, wherein six fixing blocks are disposed on one face of the disc section at equal angular intervals and a movable block is arranged between each two adjacent fixing blocks, six arced guide sections being formed the inner face of the annular wall of the rotary member corresponding to the six movable blocks, the inner end faces of the six movable blocks defining a hexagonal hole.

3. The multistage socket as claimed in claim 1 or 2, wherein an outer face of at least one fixing block of the main body is formed with a dent, a spring and a steel ball being sequentially disposed in the dent from inner side to outer side, the inner face of the annular wall of the rotary member being formed with an arced rail channel between each two adjacent arced guide sections, the steel ball being inlaid in the rail channel, whereby the rotary member can be guided by the steel ball and rotated about the disc section.

4. The multistage socket as claimed in claim 1, wherein a C-shaped retainer ring is disposed at a rear end of the annular wall of the rotary member, a front face of the C-shaped retainer ring abutting against the other face of the disc section proximal to the coupling section, whereby the rotary member is rotatably disposed around the disc section of the main body.

* * * * *